US012727733B2

(12) United States Patent
Brewer et al.

(10) Patent No.: US 12,727,733 B2
(45) Date of Patent: Sep. 8, 2026

(54) DISHWASHER APPLIANCE PUMP MOTOR COVER ACOUSTIC TUNING

(71) Applicant: Haier US Appliance Solutions, Inc., Wilmington, DE (US)

(72) Inventors: Kyle James Brewer, Louisville, KY (US); Rachel O'Bryan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 129 days.

(21) Appl. No.: 18/794,406

(22) Filed: Aug. 5, 2024

(65) Prior Publication Data

US 2026/0033699 A1 Feb. 5, 2026

(51) Int. Cl.
*A47L 15/42* (2006.01)
*F25D 17/02* (2006.01)

(52) U.S. Cl.
CPC ..... *A47L 15/4225* (2013.01); *F25D 17/02* (2013.01)

(58) Field of Classification Search
None
See application file for complete search history.

(56) References Cited

U.S. PATENT DOCUMENTS

| | | | | |
|---|---|---|---|---|
| 5,637,938 | A | 6/1997 | Vukorpa et al. | |
| 2004/0055410 | A1 | 3/2004 | Rosenbauer et al. | |
| 2009/0173368 | A1 | 7/2009 | Bragg | |
| 2016/0327048 | A1* | 11/2016 | Xu | A47L 15/4225 |

FOREIGN PATENT DOCUMENTS

| | | | |
|---|---|---|---|
| CN | 108113614 | A | 6/2018 |
| CN | 208203594 | U | 12/2018 |
| CN | 110552874 | A | 12/2019 |
| CN | 108711998 | B | 11/2020 |
| DE | 19739613 | B4 | 5/2006 |

OTHER PUBLICATIONS

CN 208203594 U machine translation, Connecting Assembly of The Pump of Dishwasher, He (Year: 2018).*

* cited by examiner

*Primary Examiner* — Cristi J Tate-Sims
(74) *Attorney, Agent, or Firm* — Dority & Manning, P.A.

(57) ABSTRACT

An appliance pump assembly includes a housing supporting an impeller for rotation within the housing, a motor coupled to the impeller to impart rotation to the impeller, and a cover affixed to the housing. The cover includes a first panel, a second panel positioned within the first panel, and a beam extending between the first panel and the second panel. The cover is defined between an inner surface and an outer surface. The first panel and the second panel are spaced apart by one or more openings formed through the inner surface and the outer surface of the cover.

20 Claims, 11 Drawing Sheets

DISHWASHER APPLIANCE PUMP MOTOR COVER ACOUSTIC TUNING

FIELD OF THE INVENTION

The present disclosure relates generally to appliances, such as dishwasher appliances, and more particularly to motor covers used in such appliances.

BACKGROUND OF THE INVENTION

Many appliances utilize fluids for various purposes, such as cleaning purposes, fluid supply purposes, etc. Dishwashers, washing machines, and refrigerators are examples of such appliances. Such appliances typically include conduits for flowing fluids therethrough, both for use in the appliance and/or for drainage from the appliance. Additionally, pumps may be utilized to encourage fluid flow through such conduits.

Known pumps utilized with appliances typically include an impeller positioned within a housing through which the fluid flows and an electric motor positioned outside of the housing coupled to the impeller to impart rotation. Pumps can vibrate due to the high rotational speed of the motor and torque pulsations at the impeller. To protect the internal components of the pump from damage or unauthorized access, pumps are often provided with one or more covers. Generally, the covers are substantially flat structures typically formed from a rigid, often fire resistant, plastic material.

In many cases, the vibration of the pump transmits vibrations to the covers, which may act as a drum or diaphragm to amplify the vibration. Consequentially, typical appliance pumps may be noisy and, in appliances such as dishwashers, may be a common source of noise for the appliance, leading to consumer dissatisfaction. Accordingly, appliance pumps that transmit less vibration and noise may be desirable. Covers for pumps that are relatively inefficient at transmitting vibration may be particularly useful.

BRIEF DESCRIPTION OF THE INVENTION

Aspects and advantages of the invention will be set forth in part in the following description, may be apparent from the description, or may be learned through practice of the invention.

In one example aspect, a dishwashing appliance is provided. The dishwashing appliance defines a vertical direction, a lateral direction, and a transverse direction. The dishwashing appliance includes a tub and defines a wash chamber and a door mounted to the tub to provide selective access to the wash chamber. The dishwashing appliance also includes a rack mounted within the wash chamber and configured for receipt of articles for cleaning, a spray assembly, and a supply conduit is fluidly coupled to the spray assembly. A pump assembly is fluidly coupled to the supply conduit. The pump assembly includes a housing supporting an impeller for rotation within the housing, a motor coupled to the impeller to impart rotation to the impeller, and a cover affixed to the housing. The cover includes a first panel, a second panel positioned within the first panel, and a beam extending between the first panel and the second panel. The cover is defined between an inner surface and an outer surface. The first panel and the second panel are spaced apart by one or more openings formed through the inner surface and the outer surface of the cover.

In another example aspect, an appliance pump assembly is provided. The appliance pump assembly includes a housing supporting an impeller for rotation within the housing, a motor coupled to the impeller to impart rotation to the impeller, and a cover affixed to the housing. The cover includes a first panel, a second panel positioned within the first panel, and a beam extending between the first panel and the second panel. The cover is defined between an inner surface and an outer surface. The first panel and the second panel are spaced apart by one or more openings formed through the inner surface and the outer surface of the cover.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
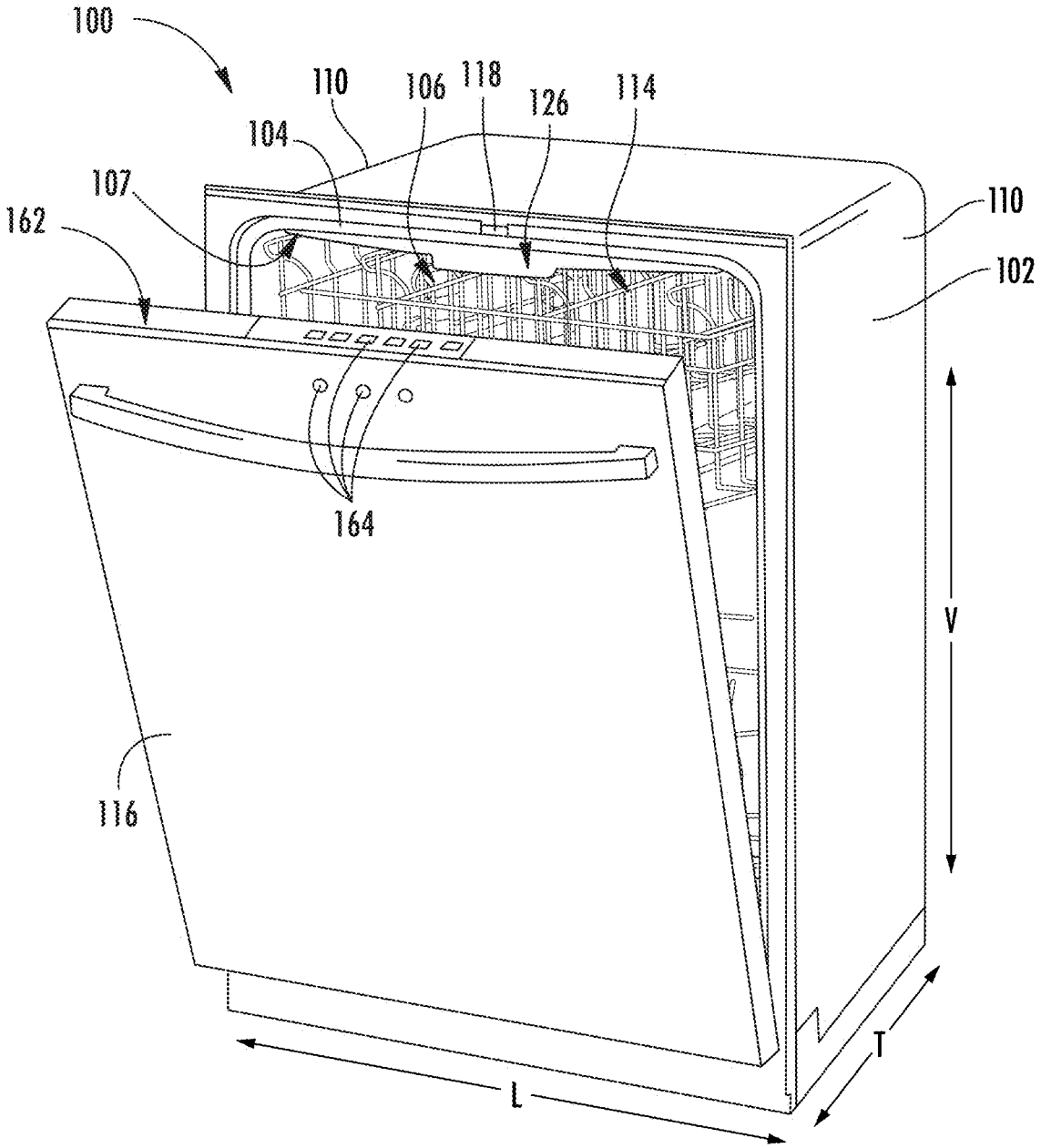
FIG. 1 provides a perspective view of an example embodiment of a dishwashing appliance of the present disclosure with a door in a partially open position.

Repeated use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

The word "example" is used herein to mean "serving as an example, instance, or illustration." In addition, references to "an embodiment" or "one embodiment" does not necessarily refer to the same embodiment, although it may. Any implementation described herein as "example" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
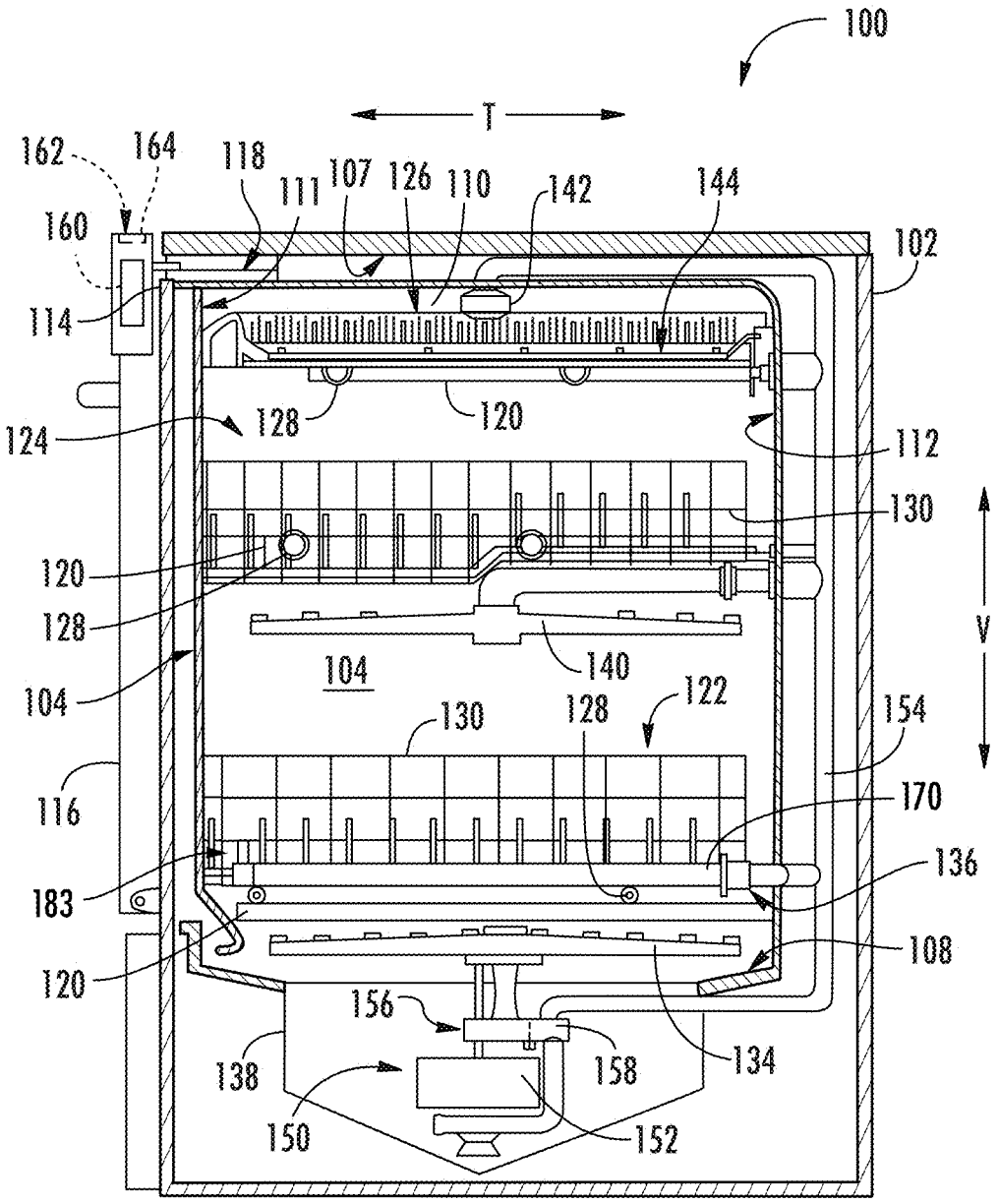
FIG. 2 provides a side, cross-sectional view of the example dishwashing appliance of FIG. 1.

Turning to the figures, FIGS. 1 and 2 depict an example domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. That is, door 116 is pivotally mounted to the cabinet 102 to provide selective access to the wash chamber 106. According to example embodiments, dishwasher 100 further includes a door closure mechanism or assembly 118 that is used to lock and unlock door 116 for accessing and sealing wash chamber 106.

As best illustrated in FIG. 2, tub side walls 110 accommodate one or more rack assemblies (three shown) configured for receipt of articles for cleaning. More specifically, guide rails 120 may be mounted to side walls 110 for supporting a lower rack assembly 122, a middle rack assembly 124, and an upper rack assembly 126 for sliding motion. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for sliding movement on the guide rails 120 between an extended loading position (second position, not shown) in which the rack is positioned at least partially outside the wash chamber 106, and a retracted position (first position, as shown in FIGS. 1 and 2) in which the rack is located inside the wash chamber 106. This is facilitated, for example, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

Some, or all, of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes an appliance pump assembly, pump assembly 152 for circulating water and wash fluid (e.g., detergent, water, and/or rinse aid) in tub 104. Pump assembly 152 may be located within sump 138 or within a machinery compartment located below sump 138 of tub 104, as generally recognized in the art. Fluid circulation assembly 150 may include one or more fluid conduits or circulation piping for directing water and/or wash fluid from pump assembly 152 to the various spray assemblies and manifolds. For example, as illustrated in FIG. 2, pump assembly 152 may be fluidly coupled to a primary supply conduit 154, along rear 112 of tub 104, along the vertical direction V, to supply wash fluid throughout wash chamber 106.

As illustrated, primary supply conduit 154 is used to supply pressurized wash fluid to one or more spray assemblies, e.g., to mid-level spray arm assembly 140 and upper spray assembly 142. However, it should be appreciated that according to alternative embodiments, any other suitable plumbing configuration may be used to supply pressurized wash fluid throughout the various spray manifolds and assemblies described herein. For example, according to another example embodiment, primary supply conduit 154 could be used to provide pressurized wash fluid to mid-level spray arm assembly 140 and a dedicated secondary supply conduit (not shown) could be utilized to provide pressurized wash fluid to upper spray assembly 142. Other plumbing configurations may be used for providing pressurized wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump assembly 152 onto dishes or other articles located in wash chamber 106. The arrangement of the discharge ports, also referred to as jets, apertures, or orifices, may provide a rotational force by virtue of pressurized wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc.

In operation, pump assembly 152 draws wash fluid in from sump 138, pressurizes the fluid, and pumps it to a diverter assembly 156 which is positioned within sump 138 of dishwasher appliance. Diverter assembly 156 may include a diverter disk (not shown) disposed within a diverter chamber 158 for selectively distributing the pressurized wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an example embodiment, diverter assembly 156 is configured for selectively distributing the flow of pressurized wash fluid from pump assembly 152 to various fluid supply conduits, only some of which are illustrated in FIG. 2 for clarity. More specifically, diverter assembly 156 may include three outlet ports (not shown) for supplying pressurized wash fluid to a first conduit for rotating lower spray arm assembly 134, a second conduit for rotating mid-level spray arm assembly 140, and a third conduit for spraying upper spray assembly 142.

Figure 3:
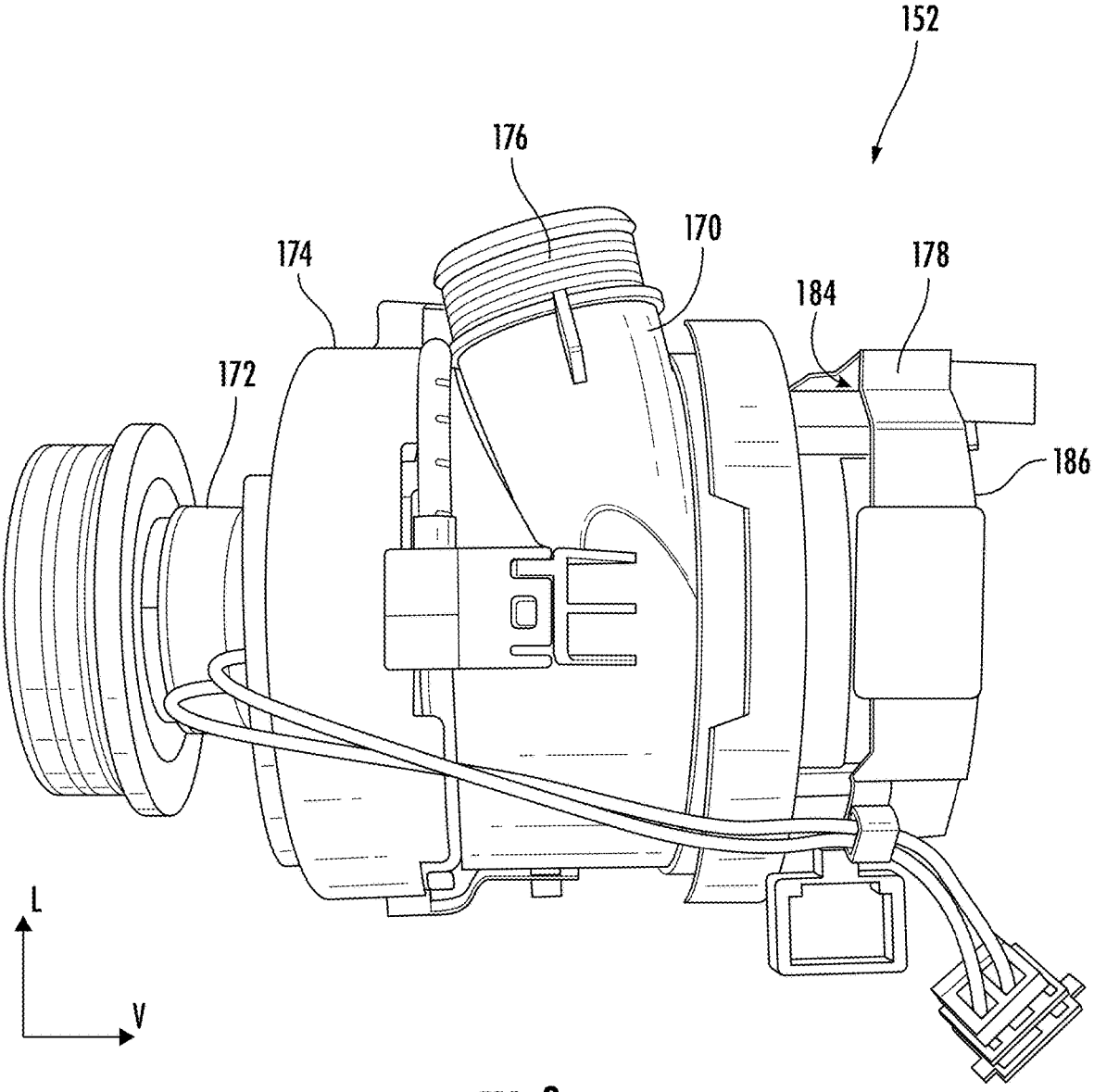
FIG. 3 provides a perspective view of a pump assembly in accordance with an embodiment of the present disclosure.

In the illustrative embodiment of FIG. 3, pump assembly 152 includes a pump central housing, housing 170, supporting an impeller (not shown) for rotation within the housing. A motor 172 is adapted to be coupled to the housing 170 such that the motor is coupled to the impeller to impart rotation to the impeller. In particular the rotor, or shaft, of motor 172 is coupled to the impeller and imparts a torque to urge the impeller to move a volume of fluid, for example wash fluid, through a pump outlet 176. As illustrated in FIG. 3, a front cover 174 is disposed over a portion of the motor 172 and may be removably fixed to a first side of the housing 170. The front cover 174 may also facilitate joining of the motor 172 to the housing 170 and/or the impeller. A back panel cover, cover 178, may be removably affixed to a second side of the housing 170, opposite the front cover 174. In general, cover 178 may be removably attached to the housing 170, such as via a plurality of fasteners, e.g., screws, or bolts. In some embodiments, at some, or all, contact points, an energy absorbing material may separate cover 178 from the housing 170, for example to isolate the cover from vibrations generated at the housing 170 or motor 172.

The dishwasher 100 may include with a controller 160 to regulate operation of the dishwasher 100. Controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, controller 160 includes a user interface panel/controls 164 through which a user may select various operational features and modes and monitor progress of the dishwasher 100. In one embodiment, user interface 164 may represent a general purpose I/O ("GPIO") device or functional block. In one embodiment, user interface 164 may include input components, such as one or more of a variety of electrical, mechanical, or electro-mechanical input devices including rotary dials, push buttons, and touch pads. User interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The example embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Moving to FIGS. 4 through 11, in general, cover 178 may include a first panel, a second panel positioned within the first panel, and a beam extending between the first panel and the second panel. In general, cover 178 may be defined between an inner surface and an outer surface. In general, the first panel and the second panel may be spaced apart by one or more openings formed through the inner surface and the outer surface of the cover. In particular, cover 178 may generally include a first panel 180 and a second panel 181 and generally define an inner surface 184 and an opposite outer surface 186 of cover 178. In other words, inner surface 184 and outer surface 186 of cover 178 may generally define a surface area of cover 178. In the illustrated embodiments, cover 178 may define one or more openings 200 formed through the cover 178, e.g., openings 200 may extend through the inner surface 184 and the outer surface 186.

Figure 4:
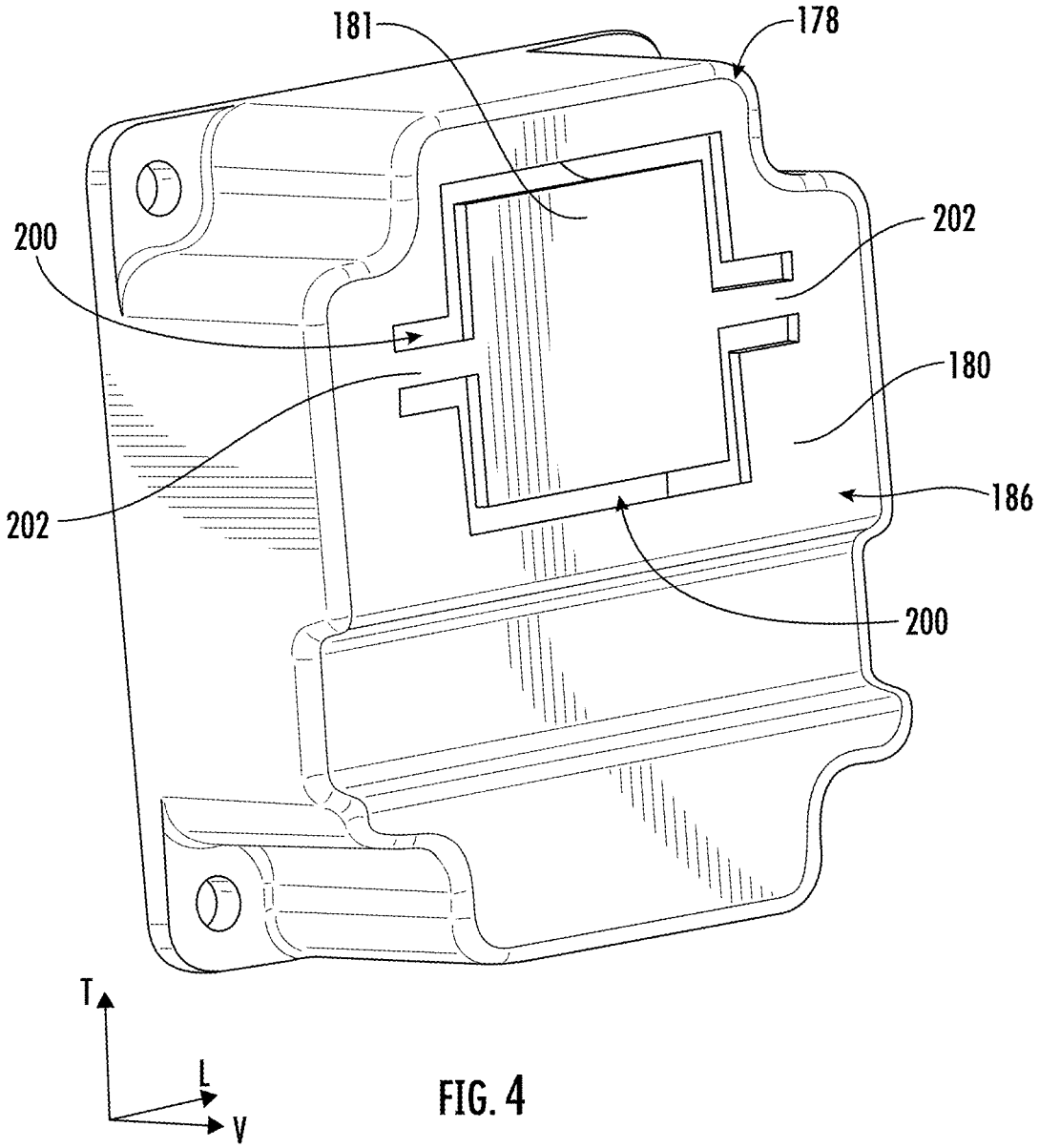
FIG. 4 provides a perspective view of a cover of the pump assembly of FIG. 3 in accordance with an embodiment of the present disclosure.

In one particular embodiment, illustrated in FIG. 4 is cover 178 including a first panel 180 and a second panel 181. In general, second panel 181 may be positioned within first panel 180, e.g., second panel may be a portion of first panel 180 separated by one or more openings 200 formed through the cover 178. As such, extending between first panel 180 and second panel 181 may be one or more of a beam 202. In particular, as shown in FIG. 4, cover 178 may include two (2) beams 202 extending between first panel 180 and second panel 181. In general, the combination of second panel 181 and beam(s) 202 may absorb/reduce noise generated by the vibrations of cover 178. In particular, second panel 181 (a mass) may be suspended from first panel 180 via beam(s) 202 (a spring), thus forming a spring-mass damper generally configured to absorb/reduce vibrations, and thus noise generated by the vibrations, of cover 178.

Figure 5:
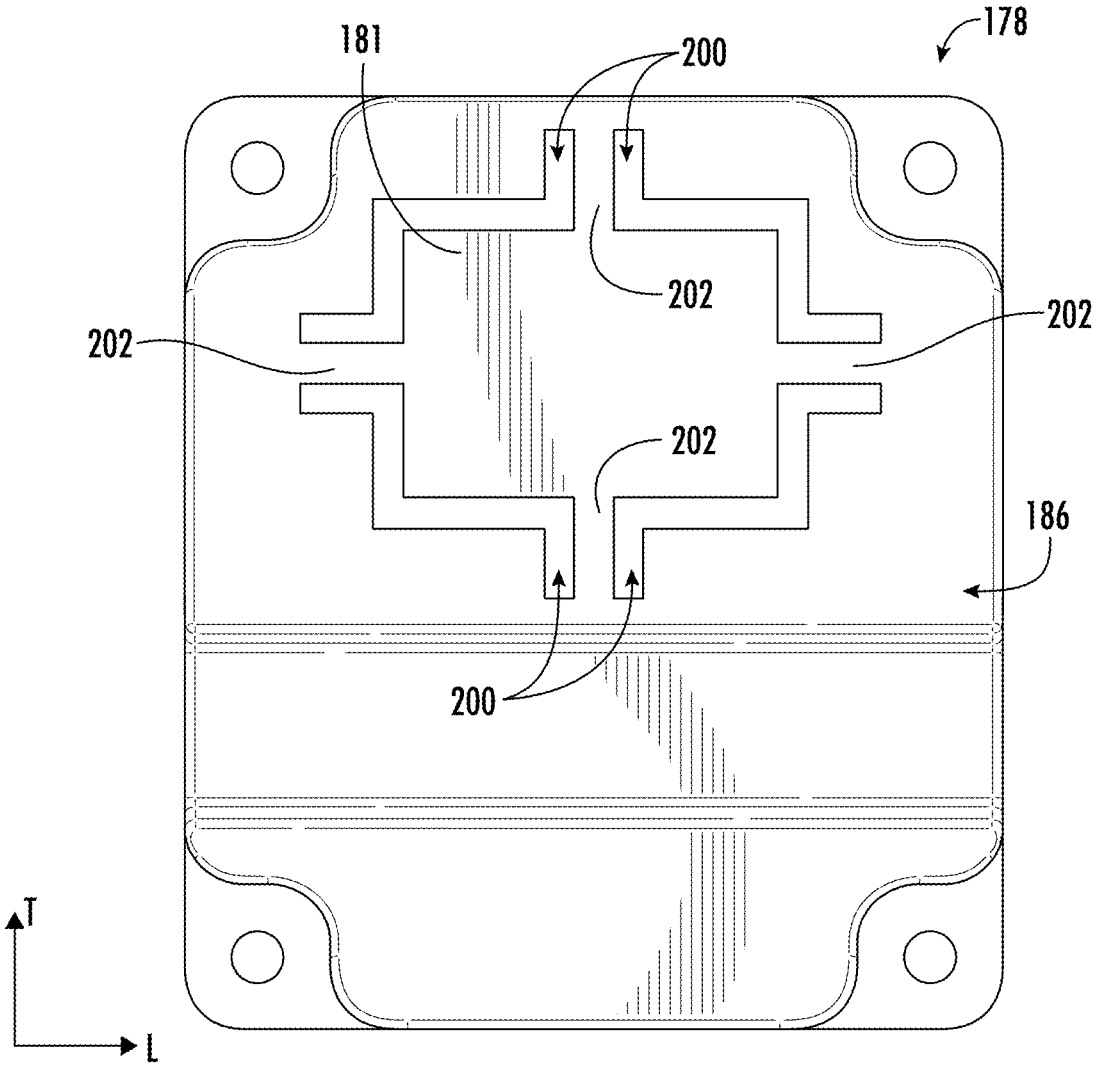
FIG. 5 provides a perspective view of another cover of the pump assembly of FIG. 3 in accordance with an embodiment of the present disclosure.
Figure 6:
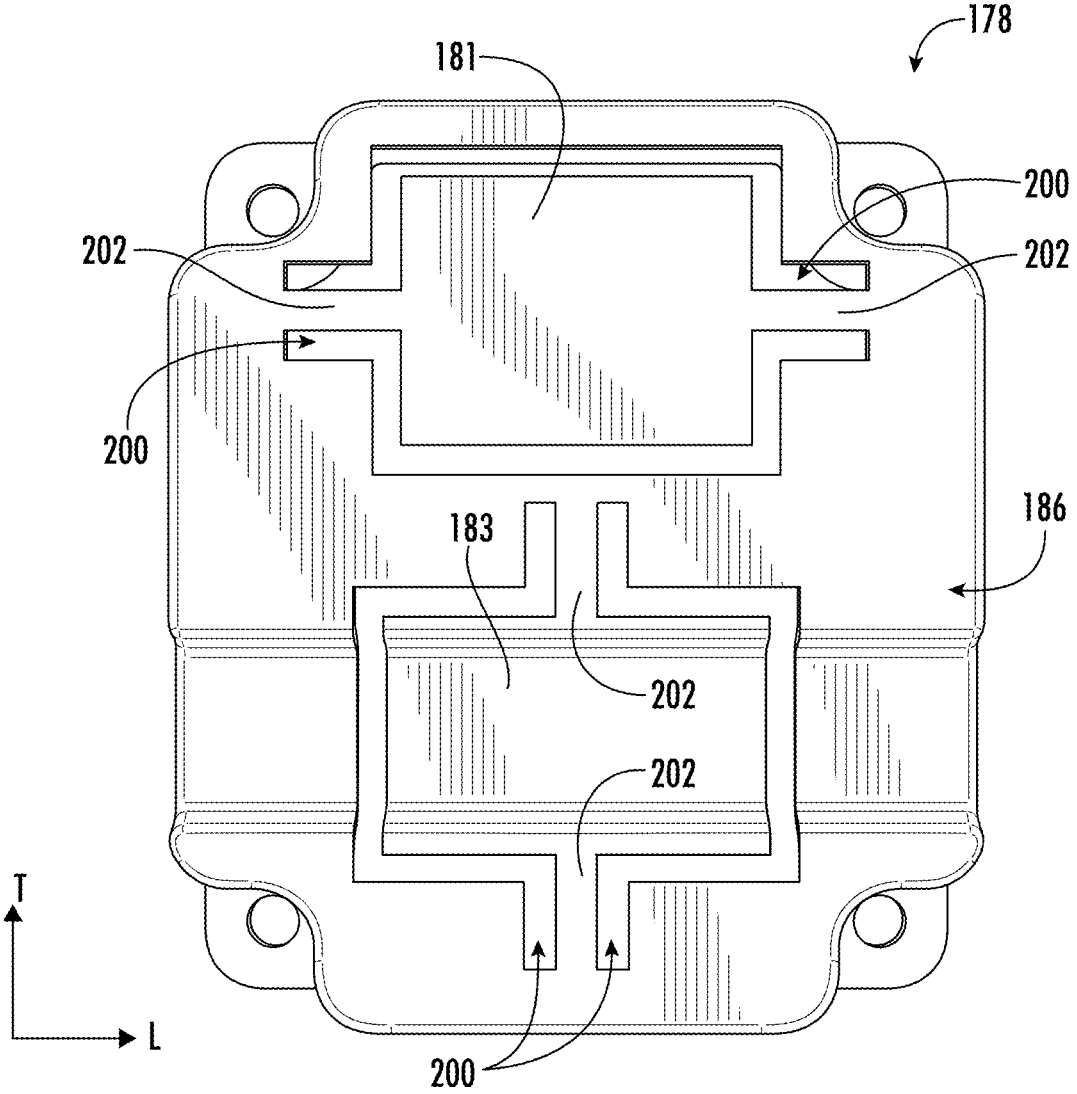
FIG. 6 provides a perspective view of another cover of the pump assembly of FIG. 3 in accordance with an embodiment of the present disclosure.
Figure 7:
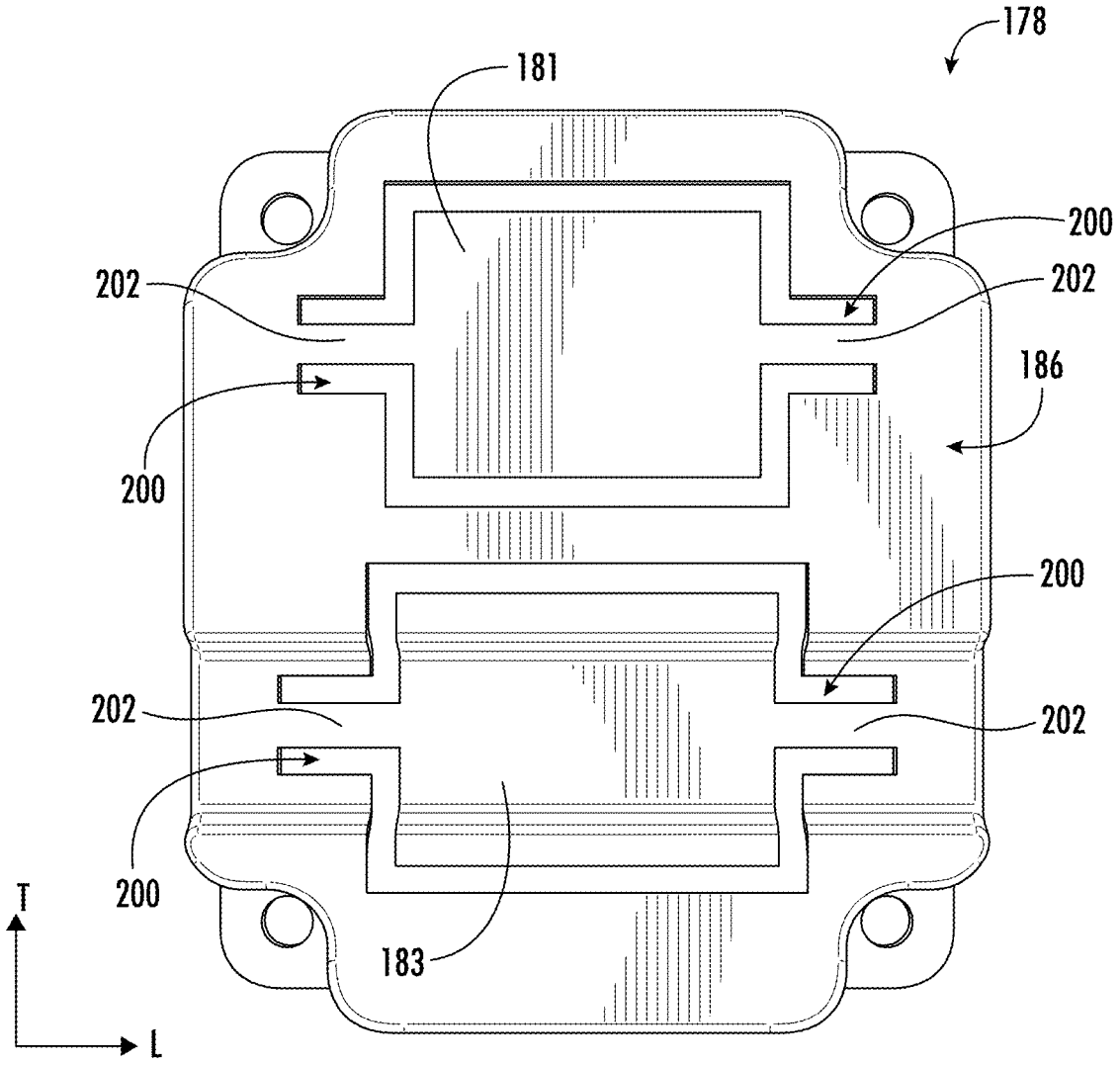
FIG. 7 provides a perspective view of another cover of the pump assembly of FIG. 3 in accordance with an embodiment of the present disclosure.
Figure 8:
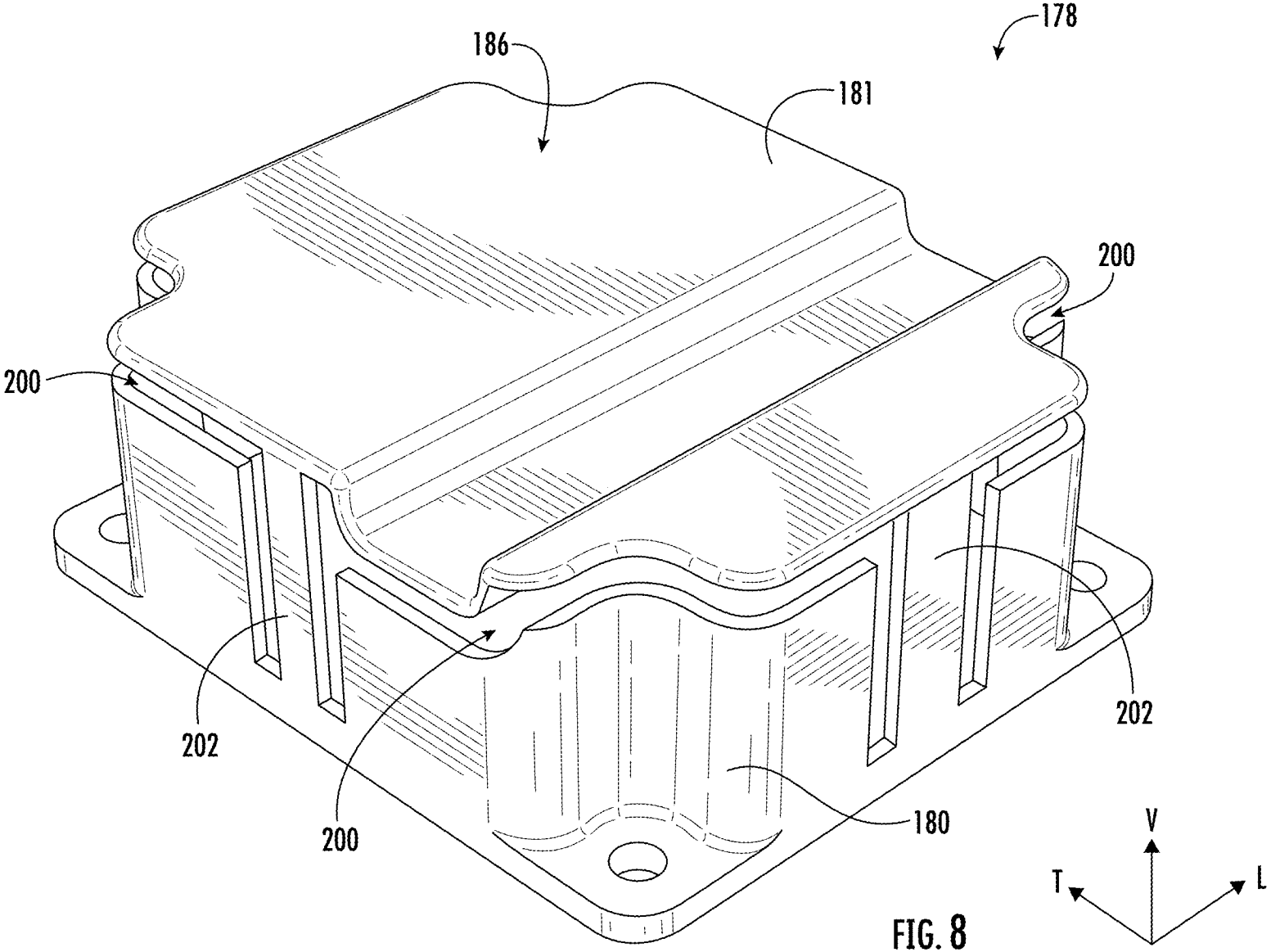
FIG. 8 provides a perspective view of another cover of the pump assembly of FIG. 3 in accordance with an embodiment of the present disclosure.
Figure 9:
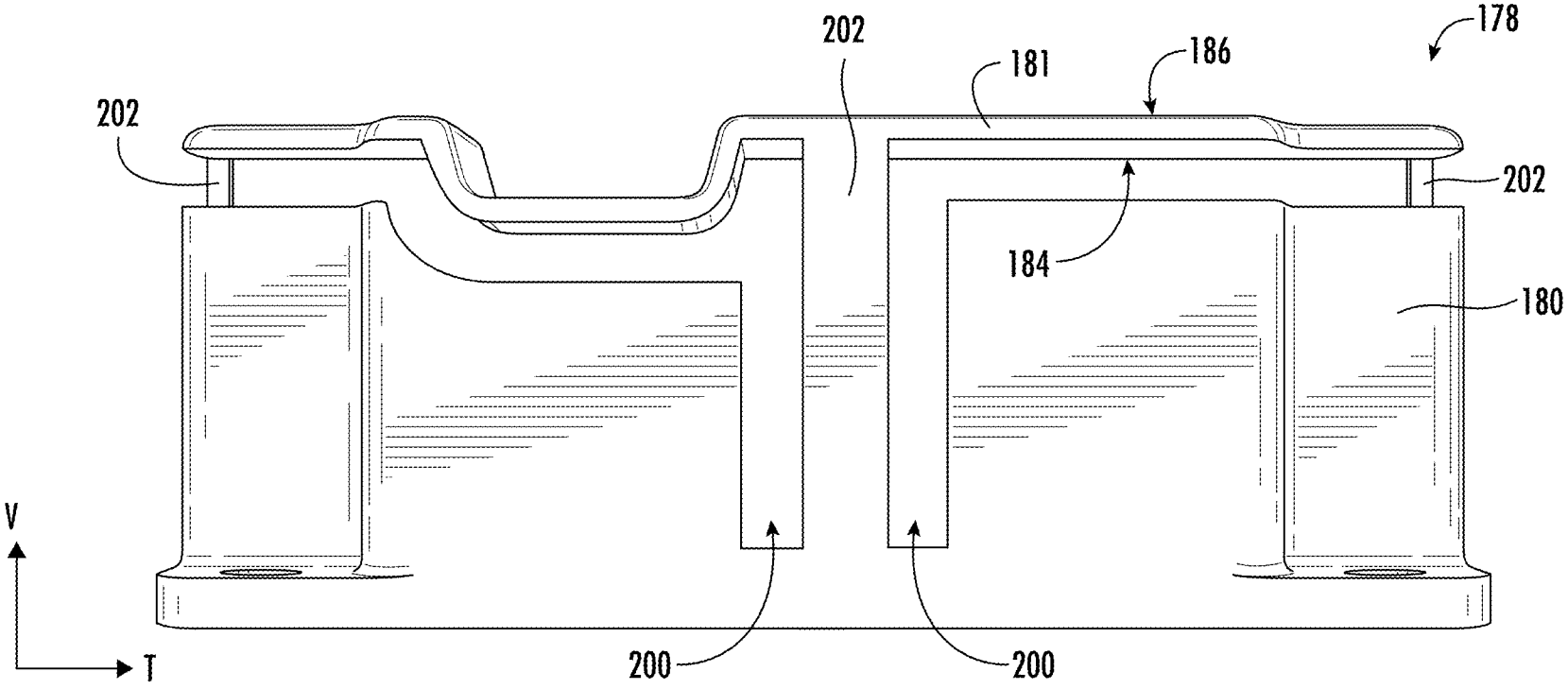
FIG. 9 provides a side view of the cover of FIG. 8 in accordance with an embodiment of the present disclosure.

Further, as may be seen in the additional, or alternative, embodiments illustrated in FIGS. 5 through 7, beam 202 extending between first panel 180 and second panel 181 may be one of a plurality of beams 202 extending between first panel 180 and second panel 181. For example, second panel 181 may include between one (1) beam 202 and three (3) beams 202 or may include four (4) beams 202 or more, such as may be seen in FIG. 5 with second panel 181 including four (4) beams 202. In general, certain example embodiments may include the plurality of beams extend in the lateral direction L and/or the transverse direction T, whereas other example embodiments may include the plurality of beams extend in the vertical direction V, such as seen in FIGS. 8 and 9, as will be explained below. In the illustrated embodiment of FIG. 5, second panel 181 includes four (4) beams 202, with two (2) beams 202 extending in the lateral direction L and two (2) beams 202 extending in the transverse direction T.

Moreover, referring now specifically to FIGS. 6 and 7, cover 178 may further include a third panel 183 positioned within first panel 180. Like second panel 181, first panel 180 and third panel 183 may be spaced apart by the one or more openings 200 formed through cover 178. Additionally, similar to second panel 181, third panel 183 may include between one (1) beam 202 and three (3) beams 202 or may include four (4) beams 202 or more, and may include the plurality of beams extending in the lateral direction L, the transverse direction T, and/or the vertical direction V. In general, one of skill in the art would understand cover 178 may include more panels positioned with first panel 180, such as four (4) panels or more. In other words, cover 178 may include multiple panels forming multiple spring-mass dampers, which may further reduce vibrations, thus further reducing noise output from cover 178.

In particular, referring again to FIGS. 4 through 11, the spring-mass damper(s), e.g., second panel 181 and third panel 183, may be tuned to have frequencies below those of particular interest, such as less than one hundred Hertz (<100 Hz) regarding sound power, or in general may be pushed to lower frequencies, such as frequencies less perceptible to a typical/average human ear, such as frequencies less than fifty Hertz (<50 Hz). For example, the surface area, or size, of second panel 181 and/or third panel 183 may be adjusted such that larger masses, or smaller masses, may be used to receive and reduce vibrations from cover 178. One of ordinary skill in the art would understand that mass is a variable in the function of a mass-spring damper system, and a full description of a mass-spring damper function/model is omitted for the sake of brevity. Moreover, one of ordinary skill in the art may understand that the shape and sizes of second panel 181, third panel 183, and openings 200 are provided by way of example only, and that any suitable shape or size of second panel 181, third panel 183, and openings 200, as described herein, may be used to achieve the desired reduction of vibrations of cover 178.

As may be seen in FIGS. 8 and 9, certain example embodiments may include the plurality of beams 202 extending in the vertical direction V. Accordingly, openings 200 may generally extend though the sidewalls of first panel 180 of cover 178. As illustrated in FIG. 8, outer surface 186 of second panel 181 may be one solid construction, however, other example embodiments may include additional panels, such as the panels illustrated in FIGS. 4 through 7 with the plurality of beams 202 extending in the lateral direction L and/or the transverse direction T, in addition to the plurality of beams 202 extending in the vertical direction.

Figure 10:
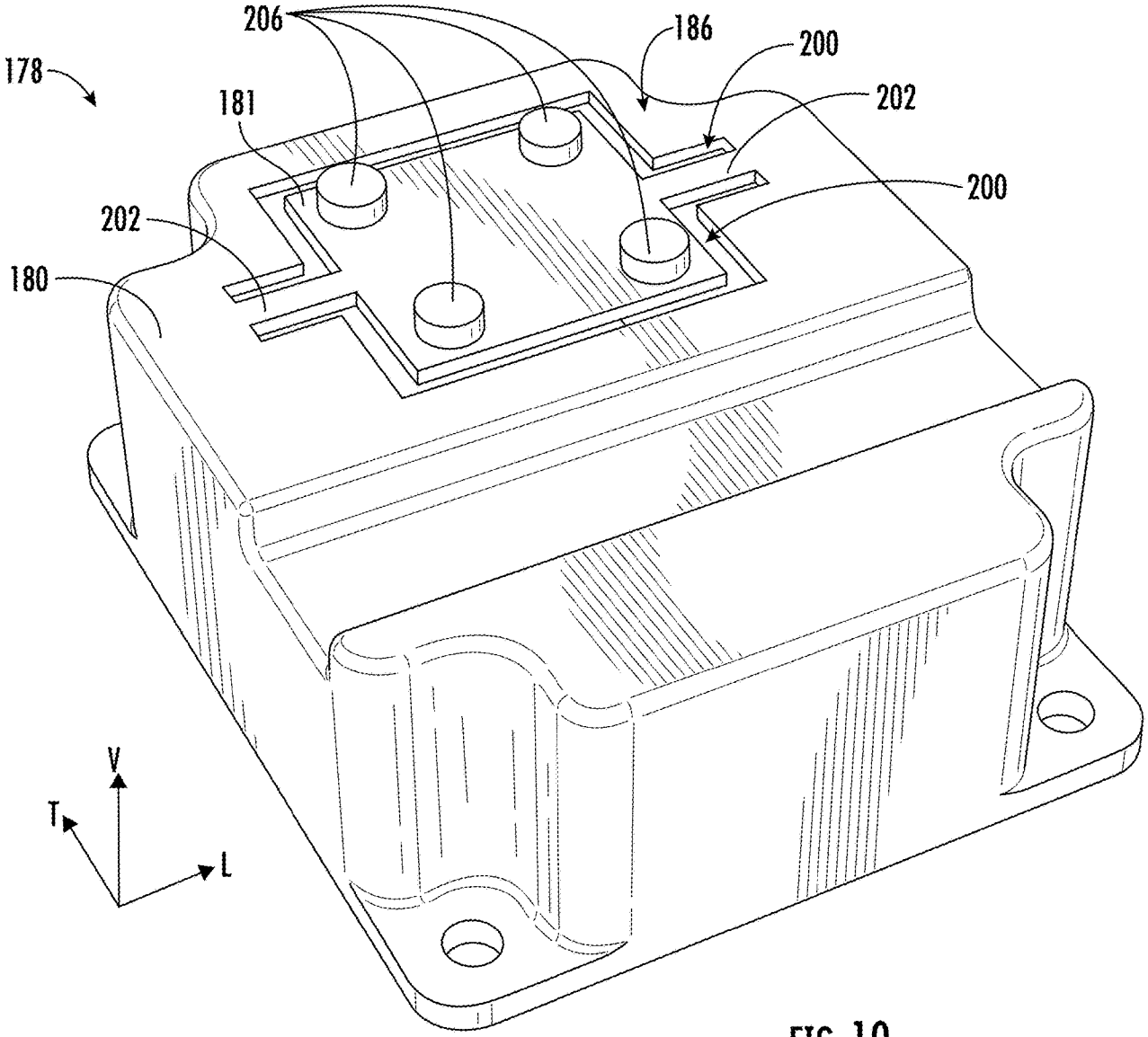
FIG. 10 provides a perspective view of another cover of the pump assembly of FIG. 3 in accordance with an embodiment of the present disclosure.
Figure 11:
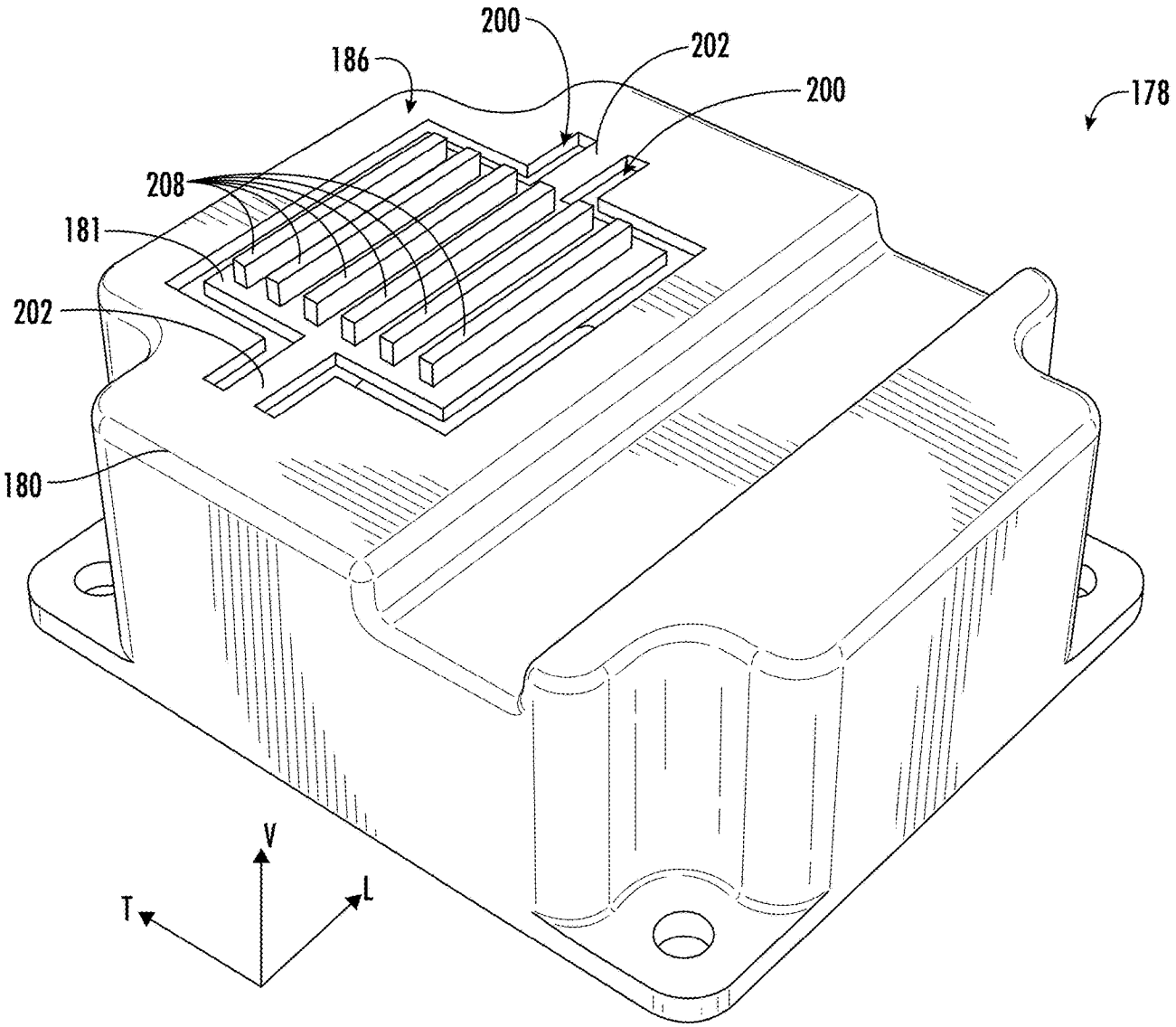
FIG. 11 provides a perspective view of another cover of the pump assembly of FIG. 3 in accordance with an embodiment of the present disclosure.

In FIGS. 10 and 11, cover 178 may generally include one or more protrusions extending from outer surface 186 of cover 178. In particular, the one or more protrusions may extend from second panel 181. In general, protrusions may be added to second panel 181, and/or third panel 183 in other example embodiments, in order to increase the mass of the panel and further reduce vibrations, thus further reducing noise output from cover 178. For example, as illustrated in FIG. 10, cover 178 may include a plurality of cylindrical tabs 206, or, as illustrated in FIG. 11, cover 178 may include a plurality of elongated ribs 208. In particular, looking at FIG. 10, the plurality of cylindrical tabs 206 may be positioned equidistantly apart on outer surface 186 of second panel 181 of cover 178. In other words, the plurality of cylindrical tabs 206 may be positioned in rows, and in some embodiments, the rows may be linear parallel rows. For example, the plurality of cylindrical tabs 206 may be equally spaced in each row and each row may be equally spaced from the adjacent row. In other embodiments, the plurality of cylindrical tabs 206 may be spaced differently in each row and adjacent rows may be spaced differently. In some example embodiments, the plurality of cylindrical tabs 206 may have the same diameter and height. In other embodiments, the plurality of cylindrical tabs 206 may have different diameters and heights. In general, one of ordinary skill in the art will recognize that any suitable number of cylindrical tabs 206 may extend from second panel 181, or third panel 183 in some example embodiments.

Looking now at FIG. 11, the plurality of elongated ribs 208 may be linear elongated ribs and may be parallel elongated ribs as illustrated. In general, the plurality of elongated ribs 208 extending from second panel 181 may be positioned parallel and equidistantly apart on outer surface 186 of second panel 181 of cover 178. In particular, the plurality of elongated ribs 208 may be positioned equidistantly apart on outer surface 186 of second panel 181 of cover 178 such that the plurality of elongated ribs 208 may be positioned in rows, and in some embodiments, the rows may be linear parallel rows. For example, the plurality of elongated ribs 208 may be equally spaced in each row and each row may be equally spaced from the adjacent row. In other embodiments, the plurality of elongated ribs 208 may be spaced differently in each row and adjacent rows may be differently spaced. In some example embodiments, the plurality of elongated ribs 208 may have the same length, width, and height. In other embodiments, the plurality of elongated ribs 208 may have different lengths, widths, and heights. In general, one of ordinary skill in the art will recognize that any suitable number of elongated ribs 208 may extend from second panel 181, or third panel 183 in some example embodiments.

In general, the plurality of cylindrical tabs 206 and the plurality of elongated ribs 208 are provided as examples, and are not meant to limit shapes, sizes, orientations, or quantities of protrusions extending from second panel 181 of cover 178. One of ordinary skill in the art will recognize that protrusions of different shapes, quantities, and orientations different than those illustrated would have similar beneficial results. For example, FIG. 10 is illustrative of the plurality of cylindrical tabs 206 and panel 180 construction in accordance with the present disclosure. FIG. 10 is illustrative of a cover 178 defining a plurality of cylindrical tabs 206 where the plurality of cylindrical tabs 206 increase the mass of second panel 181 and further reduce vibrations of cover 178 and therefore the sound transmission efficiency of cover 178.

As may be seen from the above, a dishwasher appliance may include an acoustically tuned motor cover. The geometry of the motor cover may isolate sections of the motor cover to convert vibrational energy into more desirable frequencies. A spring-mass damper may be formed on the cover by defining sections of beams (analog springs) and panels (mass) on the cover. The combination of beams and panels, e.g., a spring-mass damper, may reduce vibrations thus reducing the noise output of the cover. The panels may be tuned, by increasing the mass, to emit frequencies less perceptible to the human ear.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwashing appliance defining a vertical direction, a lateral direction, and a transverse direction, the dishwasher appliance comprising:
- a tub defining a wash chamber;
- a door mounted to the tub to provide selective access to the wash chamber;
- a rack mounted within the wash chamber and configured for receipt of articles for cleaning;
- a spray assembly;
- a supply conduit fluidly coupled to the spray assembly;
- a pump assembly fluidly coupled to the supply conduit, the pump assembly comprising:
  - a housing supporting an impeller for rotation within the housing;
  - a motor coupled to the impeller to impart rotation to the impeller; and
  - a cover affixed to the housing, the cover comprising a first panel, a second panel positioned within the first panel, and a beam extending between the first panel and the second panel, the cover defined between an inner surface and an outer surface, the first panel and the second panel spaced apart by one or more openings formed through the inner surface and the outer surface of the cover,
  - wherein the beam defines a first end adjoining the first panel to the beam, and a second end of the beam adjoining the second panel to the beam, the second panel entirely spaced apart from the first panel by the one or more openings, and
  - wherein a length of the beam along a longitudinal axis defined by the first end and the second end of the beam is at least twice as long as a width of the beam defined perpendicular to the longitudinal axis.

2. The dishwashing appliance of claim 1, wherein the beam extending between the first panel and the second panel is one of a plurality of beams extending between the first panel and the second panel.

3. The dishwashing appliance of claim 2, wherein the plurality of beams extend in the lateral direction and/or the transverse direction.

4. The dishwashing appliance of claim 2, wherein the plurality of beams extend in the vertical direction.

5. The dishwashing appliance of claim 1, further comprising a third panel positioned within the first panel, the first panel and the third panel spaced apart by the one or more openings formed through the cover.

6. The dishwashing appliance of claim 1, wherein the second panel includes one or more protrusions extending from the outer surface of the cover.

7. The dishwashing appliance of claim 6, wherein the one or more protrusions comprises cylindrical tabs extending from the second panel.

8. The dishwashing appliance of claim 7, wherein the cylindrical tabs extending from the second panel are positioned equidistantly apart on the outer surface of the second panel of the cover.

9. The dishwashing appliance of claim 6, wherein the one or more protrusions comprises a plurality of elongated ribs extending from the second panel.

10. The dishwashing appliance of claim 9, wherein the plurality of elongated ribs extending from the second panel are positioned parallel and equidistantly apart on the outer surface of the second panel of the cover.

11. An appliance pump assembly, comprising:

a housing supporting an impeller for rotation within the housing;

a motor coupled to the impeller to impart rotation to the impeller; and a cover affixed to the housing, the cover comprising a first panel, a second panel positioned within the first panel, and a beam extending between the first panel and the second panel, the cover defined between an inner surface and an outer surface, the first panel and the second panel spaced apart by one or more openings formed through the inner surface and the outer surface of the cover, wherein the beam defines a first end adjoining the first panel to the beam, and a second end of the beam adjoining the second panel to the beam, the second panel entirely spaced apart from the first panel by the one or more openings, and wherein a length of the beam along a longitudinal axis defined by the first end and the second end of the beam is at least twice as long as a width of the beam defined perpendicular to the longitudinal axis.

12. The appliance pump assembly of claim 11, wherein the appliance pump assembly defines a vertical direction, a lateral direction, and a transverse direction, wherein the beam extending between the first panel and the second panel is one of a plurality of beams extending between the first panel and the second panel.

13. The appliance pump assembly of claim 12, wherein the plurality of beams extend in the lateral direction and/or the transverse direction.

14. The appliance pump assembly of claim 12, wherein the plurality of beams extend in the vertical direction.

15. The appliance pump assembly of claim 11, further comprising a third panel positioned within the first panel, the first panel and the third panel spaced apart by the one or more openings formed through the cover.

16. The appliance pump assembly of claim 11, wherein the second panel includes one or more protrusions extending from the outer surface of the cover.

17. The appliance pump assembly of claim 16, wherein the one or more protrusions comprises cylindrical tabs extending from the second panel.

18. The appliance pump assembly of claim 17, wherein the cylindrical tabs extending from the second panel are positioned equidistantly apart on the outer surface of the second panel of the cover.

19. The appliance pump assembly of claim 16, wherein the one or more protrusions comprises a plurality of elongated ribs extending from the second panel.

20. The appliance pump assembly of claim 19, wherein the plurality of elongated ribs extending from the second panel are positioned parallel and equidistantly apart on the outer surface of the second panel of the cover.

* * * * *